United States Patent [19]

Ishihara

[11] Patent Number: 4,528,440

[45] Date of Patent: Jul. 9, 1985

[54] HAND HELD HOT AIR DRYER WITH RETRACTABLE CORD

[76] Inventor: Naoki Ishihara, Flat 209, Viking Villas, No. 70, Tin Taw Temple Rd., Hong Kong, Hong Kong

[21] Appl. No.: 527,685

[22] Filed: Aug. 30, 1983

[51] Int. Cl.[3] ..... A45D 20/12

[52] U.S. Cl. ..... 219/370; 219/366; 219/369

[58] Field of Search ..... 219/366, 367, 368, 369, 219/370, 371, 373, 374; 191/12.4; 15/DIG. 10; 34/96–101; 174/135

[56] References Cited

U.S. PATENT DOCUMENTS

| | | | |
|---|---|---|---|
| 1,027,634 | 5/1912 | Williamson | 191/12.4 |
| 1,591,901 | 7/1926 | Watts | 191/12.4 |
| 1,897,087 | 2/1933 | Tamarin | 15/DIG. 10 |
| 2,013,733 | 9/1935 | Murphy | 191/12.4 |
| 2,015,982 | 10/1935 | Witzel | 219/373 |
| 2,466,128 | 4/1949 | Striegel | 191/12.4 |
| 2,856,470 | 10/1958 | Hyde | 191/12.4 |
| 3,135,859 | 6/1964 | Mitter | 219/369 |
| 3,289,917 | 12/1966 | Buchanan | 174/135 |
| 3,846,618 | 11/1974 | Henderlite | 219/373 |

FOREIGN PATENT DOCUMENTS

| | | | |
|---|---|---|---|
| 459507 | 9/1968 | Switzerland | 219/370 |
| 2080680 | 2/1982 | United Kingdom | 219/370 |

*Primary Examiner*—Roy N. Envall, Jr.
*Assistant Examiner*—Teresa J. Walberg
*Attorney, Agent, or Firm*—Moonray Kojima

[57] ABSTRACT

A hand held hot air dryer having a manually operated reel disposed within its housing for retracting and storing an electric cord therein when not in use. The reel is connected to a conductor coated insulator disc with connection to the cord and brushes are connected to the motor and heater, thereby to provide electrical connection. A ratchet and ratchet wheel may be provided to enable locking of the reel as the winding of the cord progresses. Means are provided for preventing the cord from being pulled away from contact with the disc when the cord is being pulled out for use.

6 Claims, 6 Drawing Figures

HAND HELD HOT AIR DRYER WITH RETRACTABLE CORD

BACKGROUND OF THE INVENTION

1. Field of Invention

This invention relates to hand held hot air dryers, such as used for drying human hair, and more particularly, to such dryer using a mechanism for wrapping its electric cord when not in use.

2. Description of the Prior Art

Although hand held hair dryers are known, such as U.S. Pat. No. 3,443,329, there is a need for such hair dryers having a simple mechanism for manually retracting and storing its electric cord when not in use.

SUMMARY OF THE INVENTION

Accordingly, an object of the invention is to provide a hand held hot air dryer, such as used to dry human hair, wherein a manually rotatable take-up reel is provided within a housing for such dryer, which housing also contains a motor and a fan. A contactable circular disc and brush arrangement is attached to the reel to enable electrical connection between the cord and motor and a heater. The reel is connected to a foldable crank handle located outside the housing. The crank is used to rotate the reel and wrap the cord thereon when desired. Within the housing are provided a plurality of rollers to appropriately guide the cord to the reel. Also, disposed on the cord are one or more stoppers which are suitably located so as to prevent the cord from being pulled out too far, and to stop the cord at the end when the cord is wrapped up by the reel, respectively. A ratchet wheel is provided on a rod connecting the reel to the crank with a ratchet correspondingly located, and a release button is disposed on the outside of the housing, to enable the cord to be wrapped on the reel and locked as the wrapping progresses. The release button will release the ratchet and the cord can be pulled out for use, with the stop preventing the cord from being over extended. Thus, a simple and advantageous mechanism is provided by the invention for manually wrapping and storing the electric cord within the housing when not in use.

DETAILED DESCRIPTION OF PREFERRED EMBODIMENTS

Figures 1, 2:
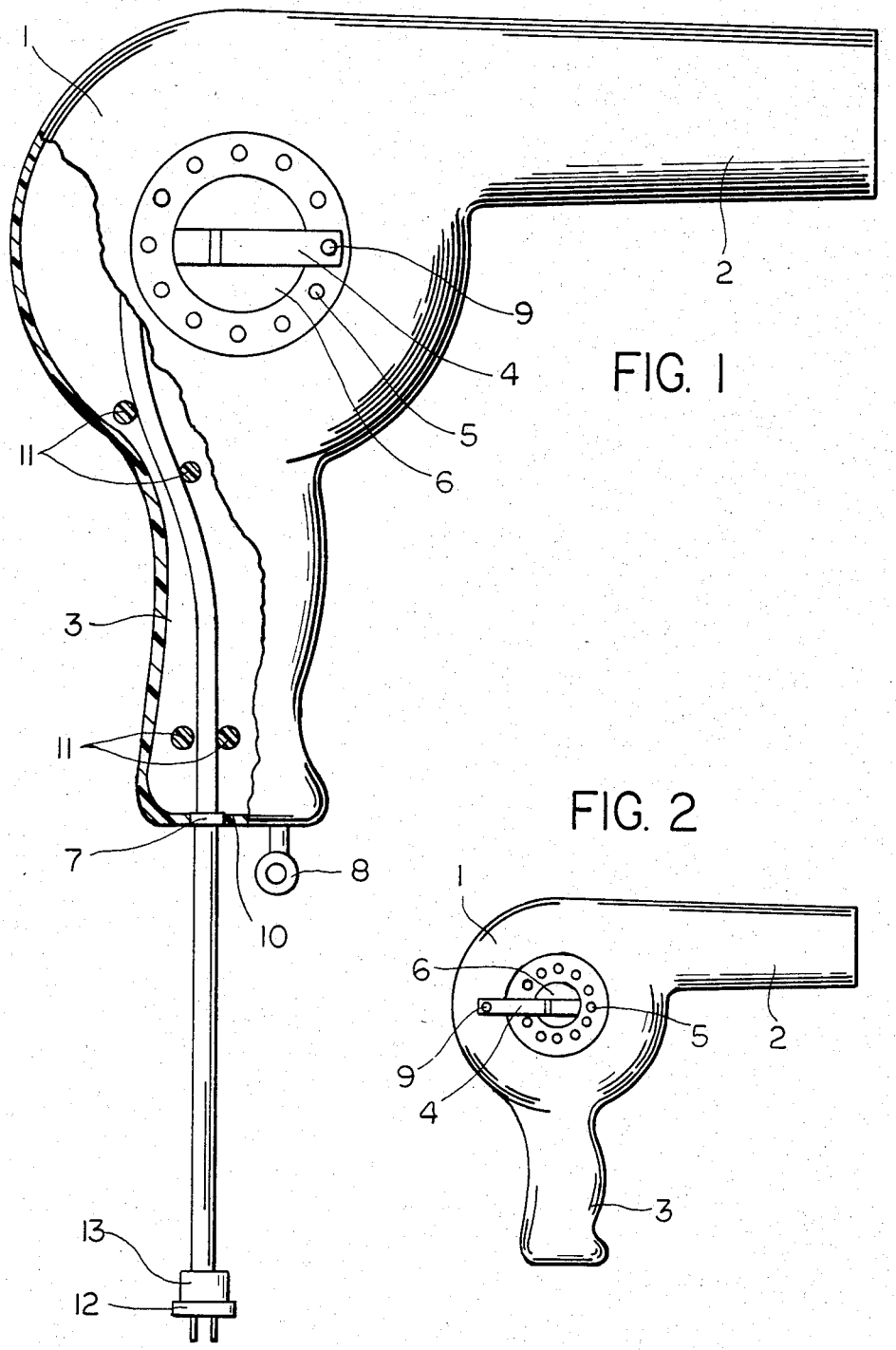
FIG. 1 is an elevational side view of an illustrative embodiment.
FIG. 2 is a part of the view of FIG. 1, showing the crank handle in an extended position.

In FIG. 1, there is depicted a hand held hot air dryer, such as used to dry human hair, comprising a housing with a central portion 1, a nozzle portion 2, and a handle portion 3. On the outside of central housing 1, on a center piece 6 is located a foldable crank 4, shown in FIG. 1 to be in a folded position. The center piece 6 has a plurality of holes 5 for ventilating a motor housed in central housing 1. The embodiment is shown having a cutaway portion to show cord 6 within handle portion 3 and extending out from an end thereof 10. The cord is guided by a plurality of rollers 11 and has at suitable points therealong a stopper 7, and at the end thereof an outlet plug 12. The outlet plug may be the same or in addition to another stopper 13.

The two stoppers 7 and 13 are used to suitably stop cord 6 from being pulled out too far when the cord is being extended and to stop the cord when being retracted. The points along the length of cord 6 at which such stops 7 and 13 are located may be varied as desired. FIG. 1 shows the cord in an extended position, such as when being used. The stops may be made of rubber, plastic or other types of suitable material.

At end 10 of handle portion 3, is depicted a closed eye portion 8, for ready hanging of the dryer by its handle on a hook when not in use.

Figure 3:
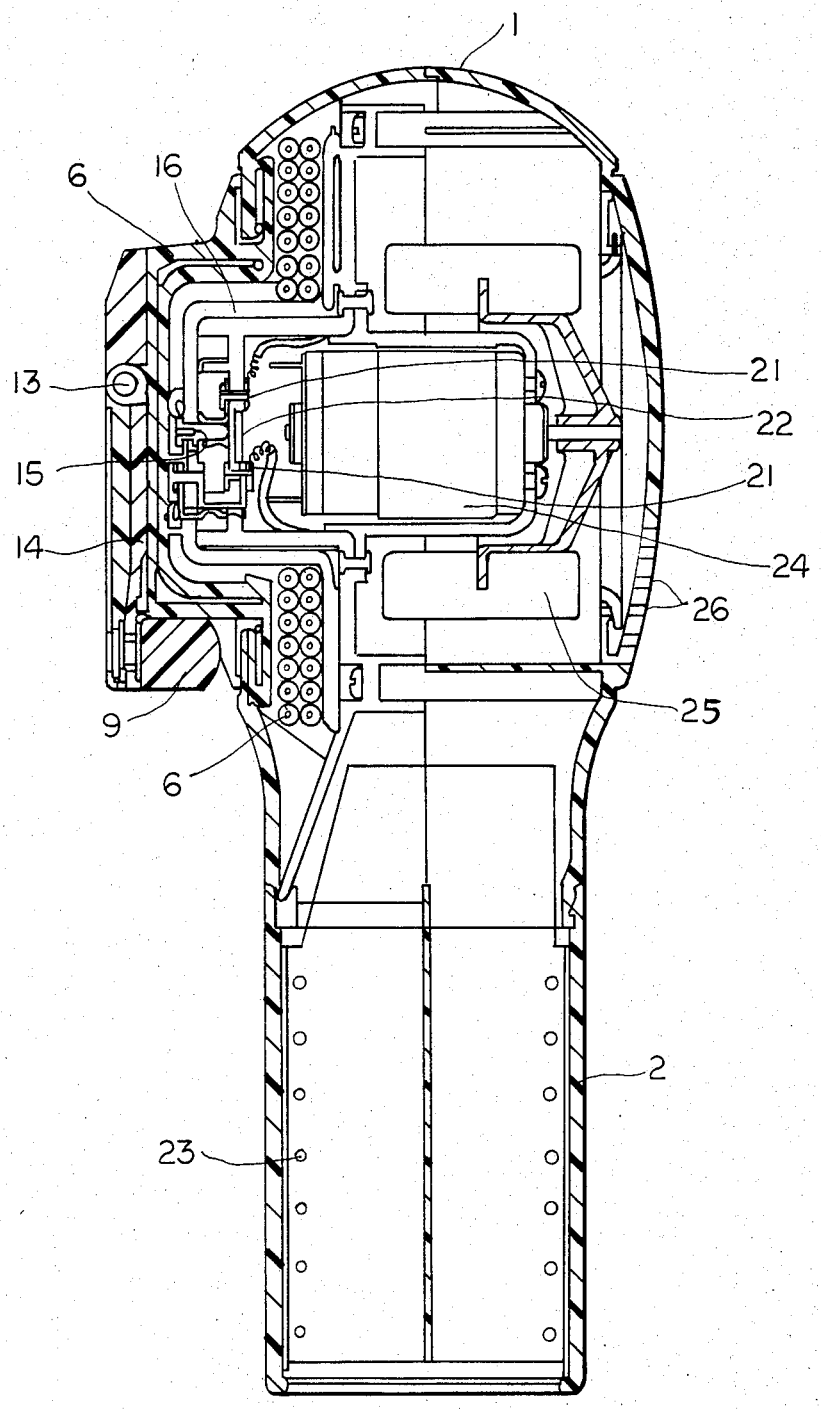
FIG. 3 is a cut-away top view of the embodiment, showing the inside of the dryer with the cord being wound on the reel.
Figure 4:
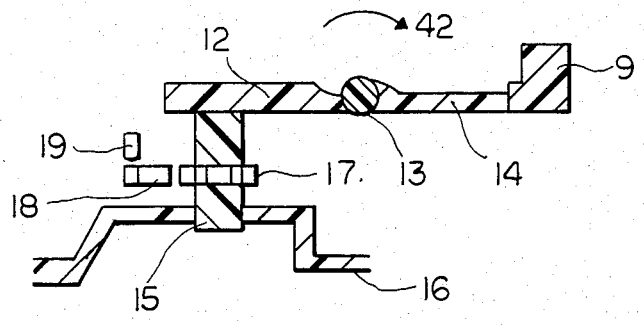
FIG. 4 depicts an enlarged view of a ratchet arrangement, with a representational push button arrangement, for release of the ratchet and an alternative type crank handle.

Turning now to FIG. 2, the view of FIG. 1 is shown, with crank handle 4 being in an extended position ready for cranking. Crank 4 has a knob 9 thereon for manual gripping to enable ready cranking and winding of a reel on which the cord is wound. Crank 4 may be as depicted in FIG. 4, wherein the crank 4 comprises a first part 12, a pin 13, and a second part 14, on which is connected knob 9. Connected to first part 12 of crank 4 is an axis shaft 15, which is connected to reel 16. Also, disposed on shaft 15, as shown more cleraly in detail in FIG. 4, is a ratchet wheel 17 with a corresponding ratchet 18. The ratchet combination is positioned in such a manner that when winding crank 4 clockwise in FIG. 2, the ratchet will operate to lock the wheel with each progressive turn, until the cord is completely wound on reel 16. When cord 6 is desired to be pulled out of handle 2, for use of the dryer, an operator pushes button 19 to release the ratchet. The button, ratchet and ratchet wheel, arrangement are shown representationally in FIG. 4 for sake of clarity, it being understood that such arrangement are part of the embodiment of FIGS. 1,2,3.

Figure 6:
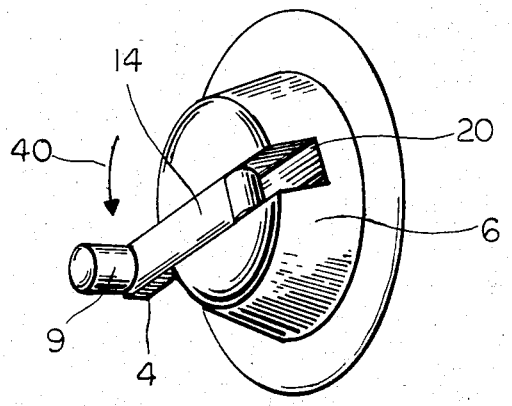
FIG. 6 depicts a perspective view of a crank handle arrangement in an extended position.

Turning to FIG. 6, there is depicted a perspective view of another crank arrangement. The center piece 6, may have a cut or channel 20 therein. The center piece 6 may have a through shaft 15 attached to reel 16 (shown representationally in FIG. 3 for sake of clarity). In the folded position of crank 4, such as depicted in FIG. 3, part 14 is folded over with button 9 being toward the end of channel 20. To extend crank 4, knob 9 is grasped and part 14 is rotated about pin 13 (see FIG. 3), in the direction shown by arrow 40 (in FIG. 6) and pulled until part 14 is level. Then, knob 9 is grasped and crank 4 is turned clockwise in FIG. 2 to wind up the cord on reel 16. The part 14 works against the side walls of channel 20 to rotate piece 6 and thereby rotate shaft 15 and rotate thereby reel 16. The center piece 6 may be thus connected to the reel 16 (as shown in FIGS. 3 and 6) and the entire center piece 6 moved with reel 16 by movement of crank 4, in place of the crank arrangement of FIG. 4.

Turning now to FIG. 3, inside of nozzle 2 is a set of heater coils 23. Inside of center housing 1, is disposed a motor 24, and a fan 25 driven by the motor 24. Housing 1 has grills 26 on the side for ventilation and air intake.

Figure 5:
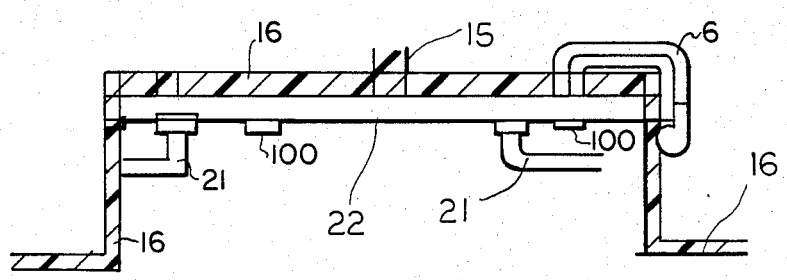
FIG. 5 depicts a circular conductive disc and brush arrangement for electrically connecting the cord with the motor and heater.

Cord 6 is connected to motor 24 and heater 23 via a conductive circular disc 22 and brush 21 arrangement. The disk may comprises a plastic insulator with strips of conductive material in contact with the brushes and connection to the cord on the opposite side via a conductor through the insulator. In FIG. 5 there is depicted a circular disk, such as of Bakelite, and having conductive bands 100 thereon which are connected on one side of disc 22 to cord 6 and on the other side of disc 22 to the motor and heater via brushes 21. The circular disk is moveable by the reel 16 (which is turned by shaft 15). In this manner, the cord 6 may be at any length and the dryer will still be operable beacause of the continual electrical contact of cord 6 with motor 24 and heater 23 via disk 22 and brushes 21.

Also disposed within housing 1 is a wind up reel 16 which is connected to a shaft 15 (see FIG. 4) which is connected to crank 4. Thus, in this instance, when crank 4 is rotated, such as in the clockwise direction in FIG. 2, the reel 16 will rotate and cord 6 will be tanken up.

In another embodiment (such as in FIGS. 3, and 6) where center part 6 is rotated by crank 4, center part 6, is connected to rotate reel 16 via a shaft connection 15, such as shown representationally in FIG. 3.

It is noted that only particular parts of an operable dryer and operation thereof are described herein, for sake of clarity and convenience. The other parts and operation thereof are known.

When the dryer of our invention is used, and cord 6 is desired to be extended, button 19 (see FIG. 4) is pushed to release the ratchet arrangement 17,18. Cord 6 is manually pulled out from handle 3 for a desired length or to the end whereat stop 7 will stop at end 10 of handle 3. Button 19 will then cause the ratchet to resiliently go against ratchet wheel 17 and lock same at that point. Thus, the desired length of cord is played out and used.

After use, the operator will take the crank 4 and extend it, and then rotate the crank 4, such as in the clockwise direction, to wind reel 16 and thus wind up the cord 6 on the reel 16, until stop 13 reaches the wall of end 10 of handle 3. The ratchet 18 is also locked in that last position of ratchet wheel 17.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. In a hand held hot air dryer comprising a housing having a nozzle portion, a handle portion and a central portion therebetween, a motor within said central portion and having a rotatable shaft, a fan disposed in said central portion and driven by said shaft of said motor for driving air through said nozzle portion, heater disposed in said nozzle portion for heating air blown by said fan prior to exit through an opening in said nozzle portion, and electric cord connected to said motor and said heater; the improvement comprising a rotatable cylindrical reel completely disposed within said central portion of said housing and about said motor and having an axis coaxial with said shaft for retracting and storing in a wound up condition said electric cord, said reel being located outside of the path of air driven by said fan;

a crank connected to said reel for manually winding up said reel thereby to wind up said electric cord, said crank being disposed outside of said central portion of said housing; and locking means for holding said reel at different positions.

2. The dryer of claim 1, wherein said crank comprises a first part, a shaft connected to said first part and to said reel, a second part connected foldably to said first part when not in use and extendible when in use, and a knob attached to said second part at an unconnected end.

3. The dryer of claim 1, wherein said crank comprises a lever, a knob attached to one end of said lever, and a rotatable piece and a shaft, said shaft being attached to said rotatable piece and attached to said reel, said rotatable piece having a channel therein at a top thereof, said lever being disposed to be foldable into said channel when not in use, and extendible outside of said channel when in use at the end to which said knob is attached, with said lever being movable by manual grasping of said knob to move said rotatable piece thereby to rotate said reel.

4. The dryer of claim 2 or 3, wherein said locking means comprises a ratchet wheel attached to said shaft, and a ratchet, and button means resiliently operating said ratchet for manually releasing said ratchet.

5. The dryer of claim 1, wherein said cord is connected to said motor and said heater by a circular disc attached to said reel and driven by said reel, said disc being of insulating material and having conductive strips attached on one side of said disc to said cord, and on another side of said disc to brushes, said brushes being connected to said heater and said motor.

6. The dryer of claim 1, wherein said cord has a first stopper means attached thereto for stopping said cord from exiting said handle portion at a predetermined point.

* * * * *